US006824438B2

(12) United States Patent
Park et al.

(10) Patent No.: US 6,824,438 B2
(45) Date of Patent: Nov. 30, 2004

(54) PLASMA DISPLAY PANEL, FABRICATING APPARATUS AND METHOD THEREOF

(75) Inventors: Se Pyo Park, Seoul (KR); Nam Yeol Yang, Kyonggi-do (KR); Jae Ha Lim, Kyongsangbuk-do (KR); Bok Yong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 73 days.

(21) Appl. No.: 10/114,108

(22) Filed: Apr. 3, 2002

(65) Prior Publication Data

US 2002/0146959 A1 Oct. 10, 2002

(30) Foreign Application Priority Data

Apr. 4, 2001 (KR) ..... P2001-17882

(51) Int. Cl.[7] ..... H01J 9/00; H01J 9/38
(52) U.S. Cl. ..... 445/24; 445/59; 445/10
(58) Field of Search ..... 445/5, 24, 25, 445/42, 43, 44, 59, 10

(56) References Cited

U.S. PATENT DOCUMENTS 5,564,958 A * 10/1996 Itoh et al. ..... 445/6
5,813,893 A * 9/1998 Robinson ..... 445/25
5,967,872 A * 10/1999 Betsui et al. ..... 445/24
6,049,167 A * 4/2000 Onitsuka et al. ..... 313/512
6,254,449 B1 * 7/2001 Nakanishi et al. ..... 445/25
6,332,821 B1 * 12/2001 Park et al. ..... 445/25
6,338,663 B1 * 1/2002 Watkins et al. ..... 445/60
6,479,944 B2 * 11/2002 Lee et al. ..... 315/169.4
6,506,089 B2 * 1/2003 Nakanishi et al. ..... 445/25
6,517,403 B1 * 2/2003 Cooper et al. ..... 445/25
6,533,630 B1 * 3/2003 Terajima et al. ..... 445/24
6,611,098 B2 * 8/2003 Mori et al. ..... 313/512
6,642,992 B2 * 11/2003 Kim ..... 349/191

FOREIGN PATENT DOCUMENTS

EP 1220269 A1 * 7/2002 ..... H01J/17/49
JP 2001319572 A * 11/2001 ..... H01J/9/26

* cited by examiner

*Primary Examiner*—Nimeshkumar D. Patel
*Assistant Examiner*—Peter Macchiarolo
(74) *Attorney, Agent, or Firm*—Fleshner & Kim LLP

(57) ABSTRACT

A plasma display panel, fabricating apparatus and method thereof for reducing a process time for a PDP fabrication as well as prevent degradation of a panel channel characteristic and panel damage. The fabricating apparatus includes air-tight equipment to form a passivation layer. The passivation layer can be formed by forming a MgO passivation layer on a first substrate, then cleaning the first substrate having the MgO passivation layer and a second substrate. Next, impurities can be removed from the first and second substrates. Finally, a coating of a UV-hardening sealant can be applied on the first substrate, where the sealant can be hardened to bond the first and second substrates to each other.

20 Claims, 9 Drawing Sheets

PLASMA DISPLAY PANEL, FABRICATING APPARATUS AND METHOD THEREOF

This application claims the benefit of the Korean Application No. P2001-17882 filed on Apr. 4, 2001, which is hereby incorporated by reference.

BACKGROUND OF THE INVENTION

1. Field of the Invention

The present invention relates to a plasma display panel, and more particularly, to a plasma display panel, fabricating apparatus and method thereof.

2. Discussion of the Related Art

Today's multimedia demands displays which can represent colors with finer and greater detail with more natural looking images than those of the conventional displays. Specifically, today's CRT (cathode ray tube) or LCD (liquid crystal display) cannot be made into large-scaled display over 40 inches, therefore a plasma display panel (hereinafter abbreviated PDP) is considered to be the next generation display.

Plasma display panels, such as the one shown in FIG. 1A, includes upper and lower plates 10 and 20 bonded to each other. FIG. 1B illustrates a cross-sectional view of a plasma display panel in FIG. 1A, in which the lower plate 20 is rotated at 90° for the convenience of explanation.

The upper plate 10 includes scan electrodes 16 and 16' and sustain electrodes 17 and 17' formed in parallel with each other, a dielectric layer 11 formed on the upper plate 10 including the scan electrodes 16 and 16' and sustain electrodes 17 and 17', and a passivation layer 12 on the dielectric layer 11. The lower plate 20 includes address electrodes 22, a dielectric film 21 on an entire surface of a substrate including the address electrodes 22, barrier ribs 23 on the dielectric film 21 between the address electrodes 22, and a fluorescent material 24 formed on surfaces of the barrier ribs 23 and dielectric film 21 inside in each discharge cell. The space between the upper and lower plates 10 and 20 is charged with a discharge gas mixed with an inert gas such as HE, Xe and the like so as to provide a discharge area.

The PDP operates by igniting the discharge gas. Once a drive voltage is applied a discharge is generated between the address and scan electrodes so that electrons discharged from the inert gas in the discharge cell by the discharge collide with a surface of the passivation layer. Such a collision of electrons causes the electrons to be discharged secondarily from the surface of the passivation layer, then the secondary electrons collide with the plasma gas so as to diffuse the discharge. After the end of the confronting discharge between the address and scan electrodes, wall charges are formed at the surface of the passivation layer on the address and scan electrodes so as to have polarities opposite from each other.

When the drive voltage applied to the address electrode is cut off, the discharge voltage having the opposite polarities is applied continuously to the scan and sustain electrodes. A voltage difference between the scan and sustain electrodes generates a surface electric discharge from the discharge area of the dielectric and passivation layers. The confronting and surface electric discharges make the electrons existing inside the discharge cell collide with the inert gas in the discharge cell. Resultingly, the inert gas in the discharge cell becomes excited so as to generate a UV-ray having a wavelength of 147 nm in the discharge cell. Such a UV-ray collides with the fluorescent material surrounding the barrier ribs and address electrode so as to realize an image.

Hence, in order to make PDP give full play to its performance and extend its endurance, the panel should have strong layers as well as no impurity gas inside.

For convenience, a fabrication method of such PDP is mainly divided into a pre-process, an after-process, and a module process.

First, various layers are formed on the upper and lower plates 10 and 20 in the pre-process. And, the after-process includes a bonding step of the upper and lower plates 10 and 20, electric discharge gas injection and tip-off steps, an aging step, and a checking step. In this case, 'tip-off' is the step of sealing an exhaust pipe by melting after the completion of exhaust and electric discharge gas injection through the exhaust pipe, and 'aging' is the step of applying a power to electrodes for a predetermined time to drive so as to remove impurities finally as well as realize an electric discharge voltage drop effect. Circuits and packages are then assembled so as to complete the PDP in the module process.

FIG. 2 illustrates an after-process and process conditions of a plasma display panel according to a related art. FIG. 3A to FIG. 3C illustrates layouts for a bonding process in FIG. 2, FIG. 4 illustrates a cross-sectional view of an exhaust pipe, FIG. 5 illustrates a layout of a separative bonding/exhaust apparatus of a plasma display panel according to a related art, and FIG. 6 illustrates a diagram of a cart in FIG. 5.

The after-process of PDP according to the related art, as shown in FIG. 2, including bonding, exhausting, electric discharge gas injecting, tipping-off, and aging.

First, the upper and lower plates 10 and 20 are transferred to a bonding equipment. Next, a circumference of the upper plate 10, as shown in FIG. 3A, is coated with a sealant 31, i.e. frit to a predetermined thickness using a dispenser. In this case, frit consists of glass and an additive improving adhesiveness.

A drying is carried out at about 120° C., and then a plasticizing is carried out above 400° C. so as to remove impurities remaining in the frit. Subsequently, the upper and lower plates having completed the plasticizing are transferred to the bonding equipment. In this case, the upper plate 10 is exposed to atmosphere so as to be moved to the bonding equipment.

The upper and lower plates 10 and 20, as shown in FIG. 3B, are aligned with each other in the bonding equipment, and fixed thereto by tongs 32. The frit is then melted, as shown in FIG. 3C, so as to bond the upper and lower plates 10 and 20 to each other.

Additionally, in the bonding step, an exhaust pipe 40 like a straw made of glass, as shown in FIG. 4, is attached to an exhaust hole 42 of the lower plate 20 using a frit ring 41. Subsequently, the panel of which bonding step is completed is transferred to an exhaust and gas injection equipment.

Then, the exhaust and gas injection equipment carries out the exhaust step of discharging externally an impurity gas generated from the layers and impurities adhering to the layers on heating condition at high vacuum using the exhaust pipe 40 formed in the binding step. An electric discharge gas is then injected through the exhaust pipe 40, and then the tip-off step is carried out in a manner that a tip of the exhaust pipe 40 is heated to melt so as to prevent the injected electric discharge gas from leaking. Finally, a status of the panel is checked after the aging step so as to complete the whole process.

The separative type fabricating equipment in an exhaust type apparatus, which carries out the bonding and exhaust/ gas injection steps separately, are divided into the bonding equipment and the exhaust/gas injection equipment. The exhaust/gas injection equipment, as shown in FIG. 5, includes a hot wind heating furnace 51 providing conditions for exhaust/electric discharge gas injection and a cart 52 loading the panel 33 as well as unloading the panel after the exhaust/electric discharge gas injection in the hot wind heating furnace 51.

The cart 52, as shown in FIG. 6, has a complicated structure including a vacuum pump 61 providing a panel with a vacuum state, a vacuum pipe system constructed with an exhaust manifold 62, valves, ad pipes, an electric discharge gas injection bomb 65, a gas injection pipe system constructed with a gas injection manifold 63, valves, and pipes, and a tip-off unit 64 tipping off the exhaust pipe 40.

Unfortunately, the apparatus and method for fabricating PDP have the following problems or disadvantages.

First, it takes a relatively long time (about 24 hours) to suck out the impurity gas through a several-hundred-microns gap between the bonded upper/lower plates of an at least 40-inch panel as well as inject the electric discharge gas through the gap.

Second, the panel is heated at a highly vacuum state so as to receive a huge load thereon. Since the panel is made of glass vulnerable to thermal deviation and tensile strength, the panel may be broken or degrade its characteristics.

Third, the plasticizing step is carried out to remove the impurities of the frit used for the attachment of the upper and lower plates. The heating/cooling of the plasticizing step increases its energy consumption as well as a quantity of the impurities from the frit due to the high temperature in the bonding step. Hence, the exhaust time extends. And, the frit itself is fragile to an external impact, thereby becoming one reason of the panel crack on external impact.

Fourth, the passivation layer of the upper plate according to a related art plays an important role in preventing the damage of electrodes caused by electric discharge. The passivation layer is exposed to atmosphere so as to be moved to a bonding stage. The exhaust and electric discharge gas injection steps are then carried out on the upper plate including the passivation layer. Since MgO used mainly for a passivation material is easy to combined with atmospheric components such as moistness and the like so as to be contaminated. Therefore, such a passivation layer reduces a product performance as well as endurance.

In order to overcome the above problems of the exhaust pipe system, a tip-less system, which uses no exhaust pipe, has been proposed. The tip-les system carries out the exhaust step prior to the bonding step, thereby requiring no exhaust pipe.

Yet, in the tip-les system, the bonding step should be carried out on condition that the chamber is filled with the electric discharge gas. Hence, when the frit is melt, a great deal of impurity gas is generated so as to contaminate the expensive electric discharge gas. Such a contamination makes the electric discharge gas useless fatally, whereby it is unable to apply the tip-less system to a real production.

Moreover, a semi-tip-less system, which injects the electric discharge gas through an extra-hole instead of filing the chamber with the electric discharge gas, has been proposed to prevent the above-explained contamination of the electric discharge gas. Yet, the semi-tip-les system is carried out in a manner that the injection hole is closed up with a coin-like stopper so as to be airtight by melting a frit. Hence, the impurity gas generated from the melt frit penetrates the panel internally so as to bring about the same fatal problem of the tip-less system, the contamination of the electric discharge gas. Thus, it is unable to apply the tip-less system to a real production as well.

Resultingly, the PDP fabrication method using the exhaust pipe according to the related art requires a long exhaust time due to the frit contamination and impurities remaining in the panel, thereby extending an overall product process time. Hence, a sufficient equipment space is required for mass production. And, the vacuum/highly-thermal processes, the exposure of the passivation layer to atmosphere, the deterioration of the panel, and the exhaust pipe bring about the characteristic and performance degradation inevitably.

SUMMARY OF THE INVENTION

Accordingly, the present invention is directed to a plasma display panel, fabricating apparatus and method thereof that substantially obviates one or more problems due to limitations and disadvantages of the related art.

An object of the present invention is to provide a plasma display panel, fabricating apparatus and method thereof enabling to reduce a process time for a PDP fabrication as well as prevent a degradation of a panel channel characteristic and panel damage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for fabricating a plasma display panel according to the present invention includes a passivation layer forming equipment for forming a MgO passivation layer on a first substrate, a cleaning equipment for removing impurities existing on the first substrate having the passivation layer and a second substrate and carrying out vacuum exhaust, and an electric discharge gas injection/bonding equipment for coating a sealant hardened by UV-rays on the second substrate cleaned through the cleaning equipment, irradiating the UV-rays on the second substrate attached closely to the first substrate while an electric discharge gas is injected so as to carry out a bonding between the first and second substrates.

In another aspect of the present invention, a method of fabricating a plasma display panel, which is carried out in a fabricating apparatus including first to third equipments built airtight in one body so as to carry out a passivation layer forming to an electric discharge gas injection/bonding therein, includes a passivation layer forming step of forming a MgO passivation layer on a first substrate in the first equipment, a cleaning step of transporting the first substrate having the MgO passivation layer and a second substrate to the second equipment, removing impurities existing on the first and second substrates by generating a plasma electric discharge between the first and second substrates using an electric discharge gas in the second equipment, and carrying out vacuum exhaust, and a bonding step of transporting the cleaned first and second substrates to the third equipment, coating a UV-hardening sealant on the first substrate, filing the third equipment with the electric discharge gas, attaching the first substrate closely to the second substrate, irradiating UV-rays on the sealant to be hardened so as to bond the first and second substrates to each other.

In a further aspect of the present invention, a plasma display panel using an epoxy-based sealant hardened by UV-rays so as to bond upper and lower plates to each other.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
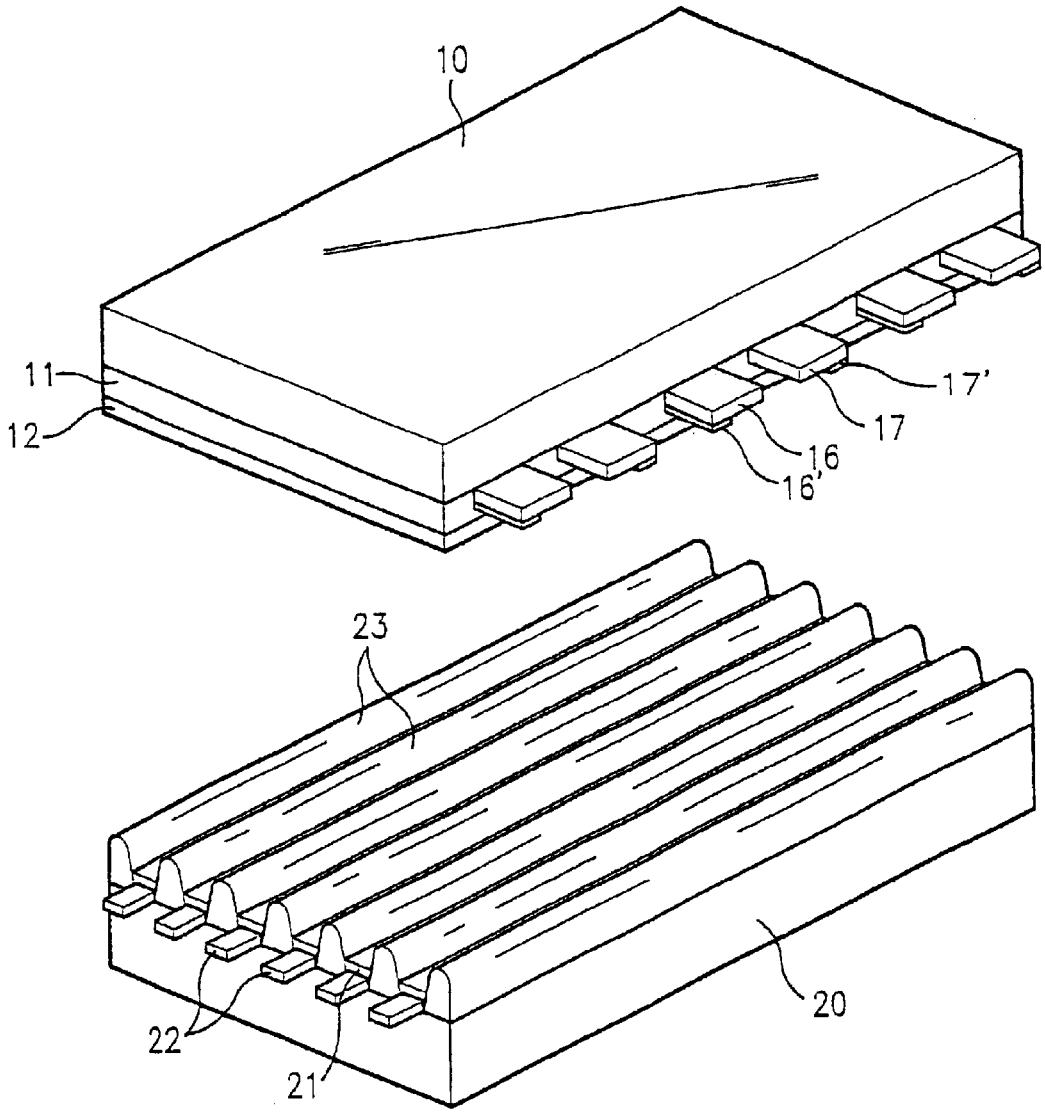
FIG. 1A Related Art
FIG. 1A illustrates a bird's-eye view of a general plasma display panel.
Figure 1B:
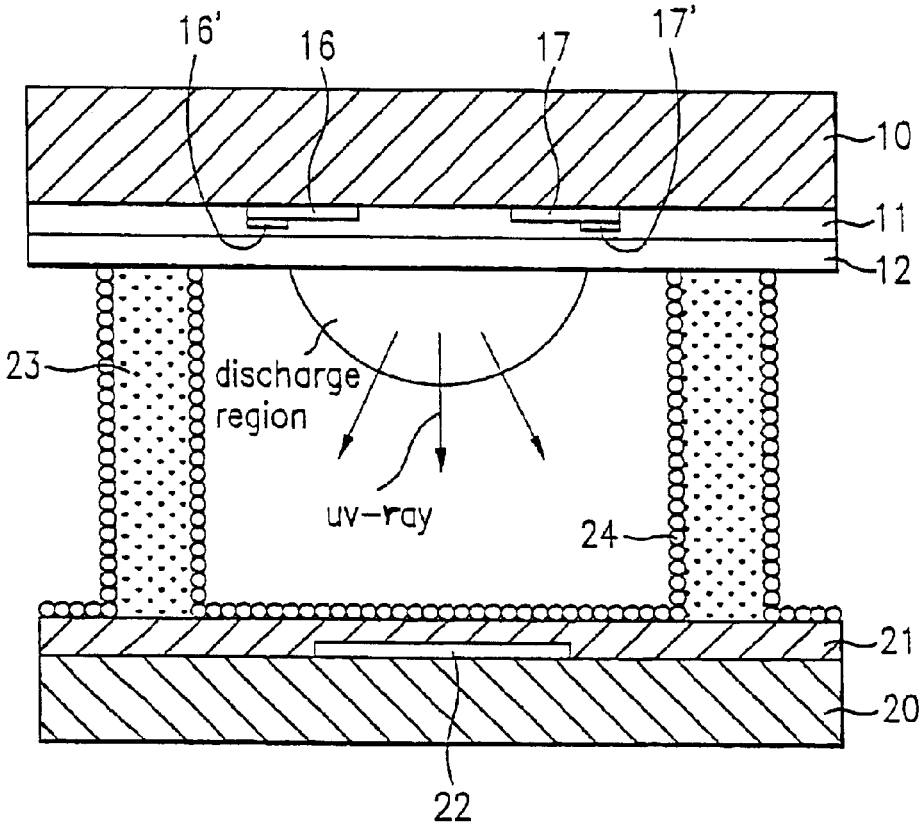
FIG. 1B Related Art
FIG. 1B illustrates a cross-sectional view of a general plasma display panel.
Figure 2:
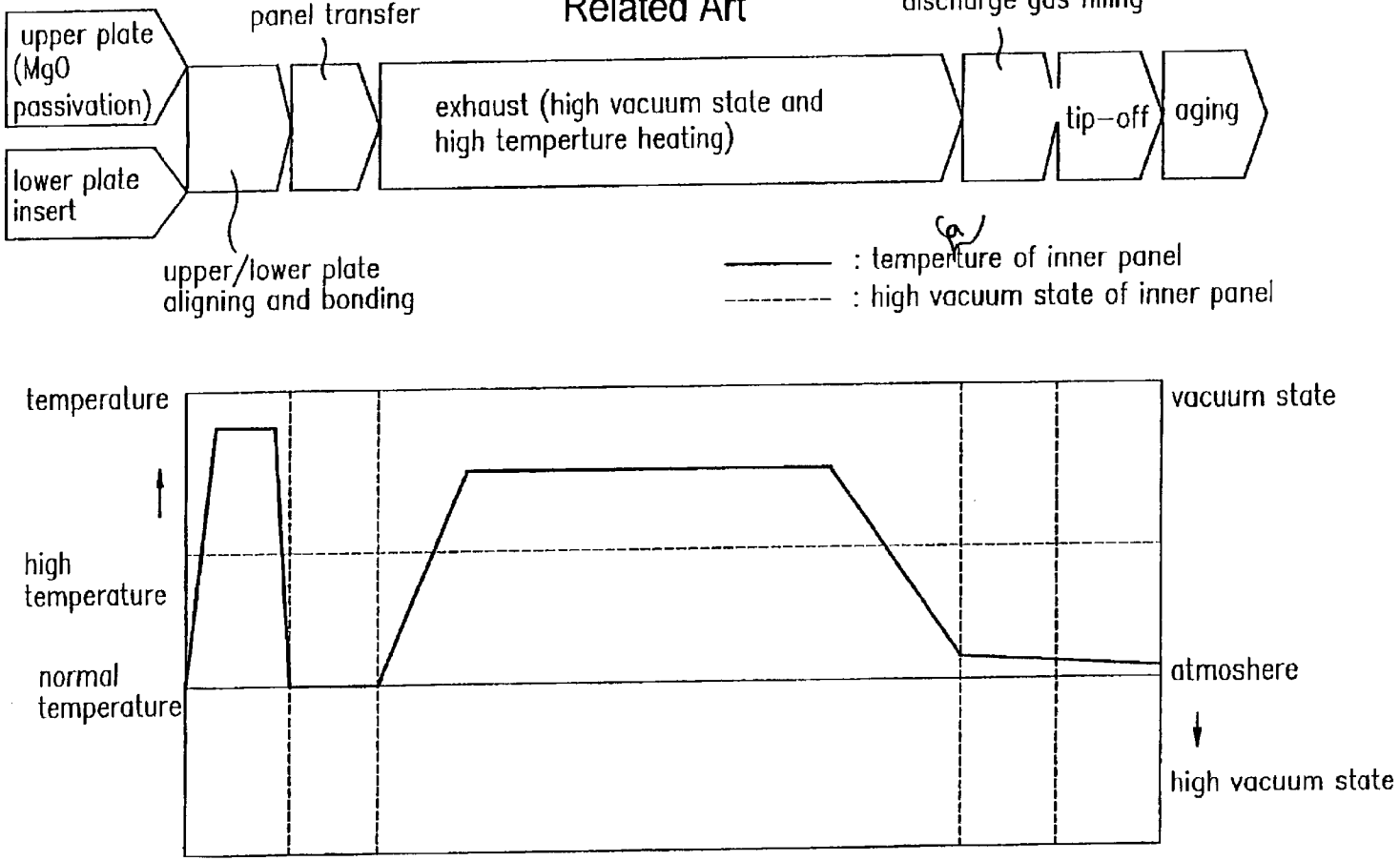
FIG. 2 Related Art
FIG. 2 illustrates a diagram of an after-process and process conditions of a plasma display panel according to a related art.
Figure 3A:
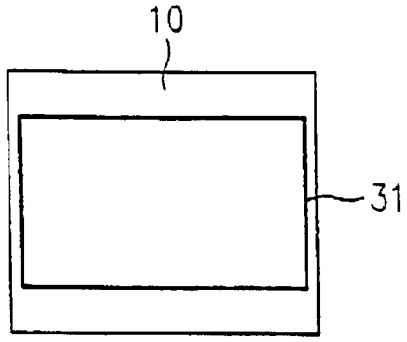
FIG. 3A Related Art
FIG. 3A to FIG. 3C illustrate layouts for a bonding process in FIG. 2.
Figure 3B:
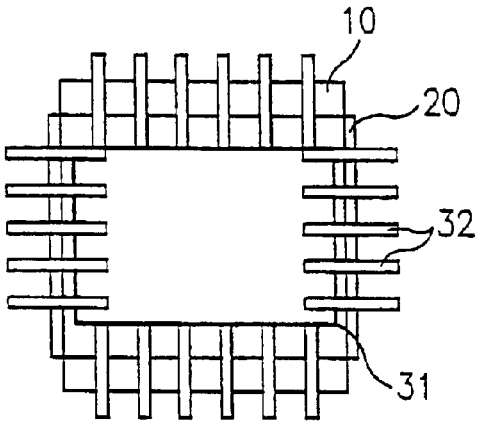
FIG. 3B Related Art
Figure 3C:
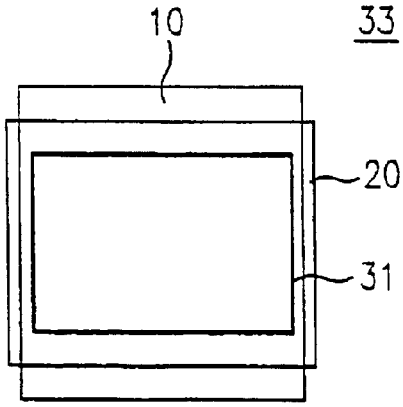
FIG. 3C Related Art
Figure 4:
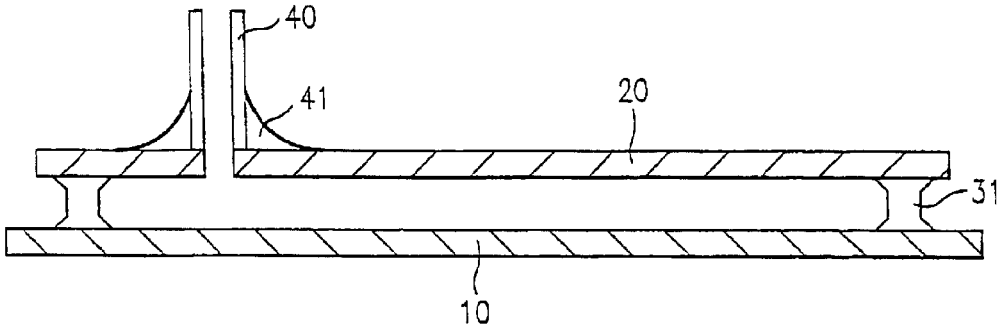
FIG. 4 Related Art
FIG. 4 illustrates a cross-sectional view of an exhaust pipe.
Figure 5:
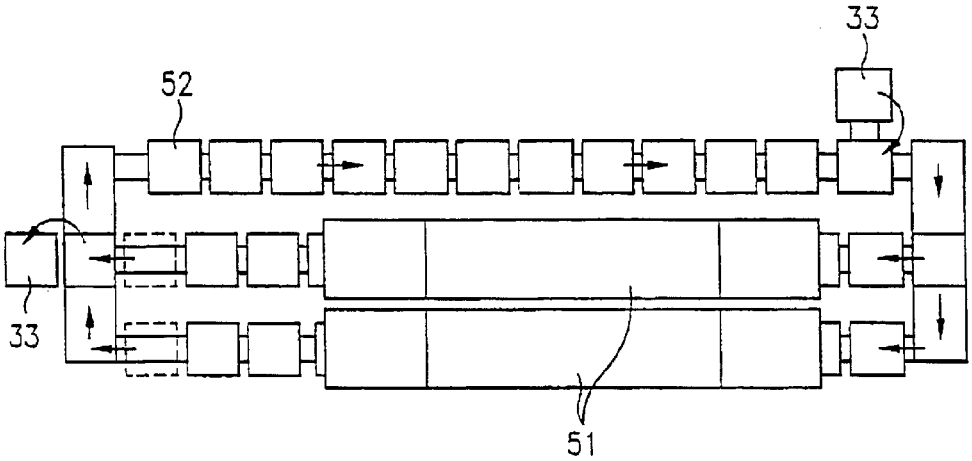
FIG. 5 Related Art
FIG. 5 illustrates a layout of a separative bonding/exhaust apparatus of a plasma display panel according to a related art.
Figure 6:
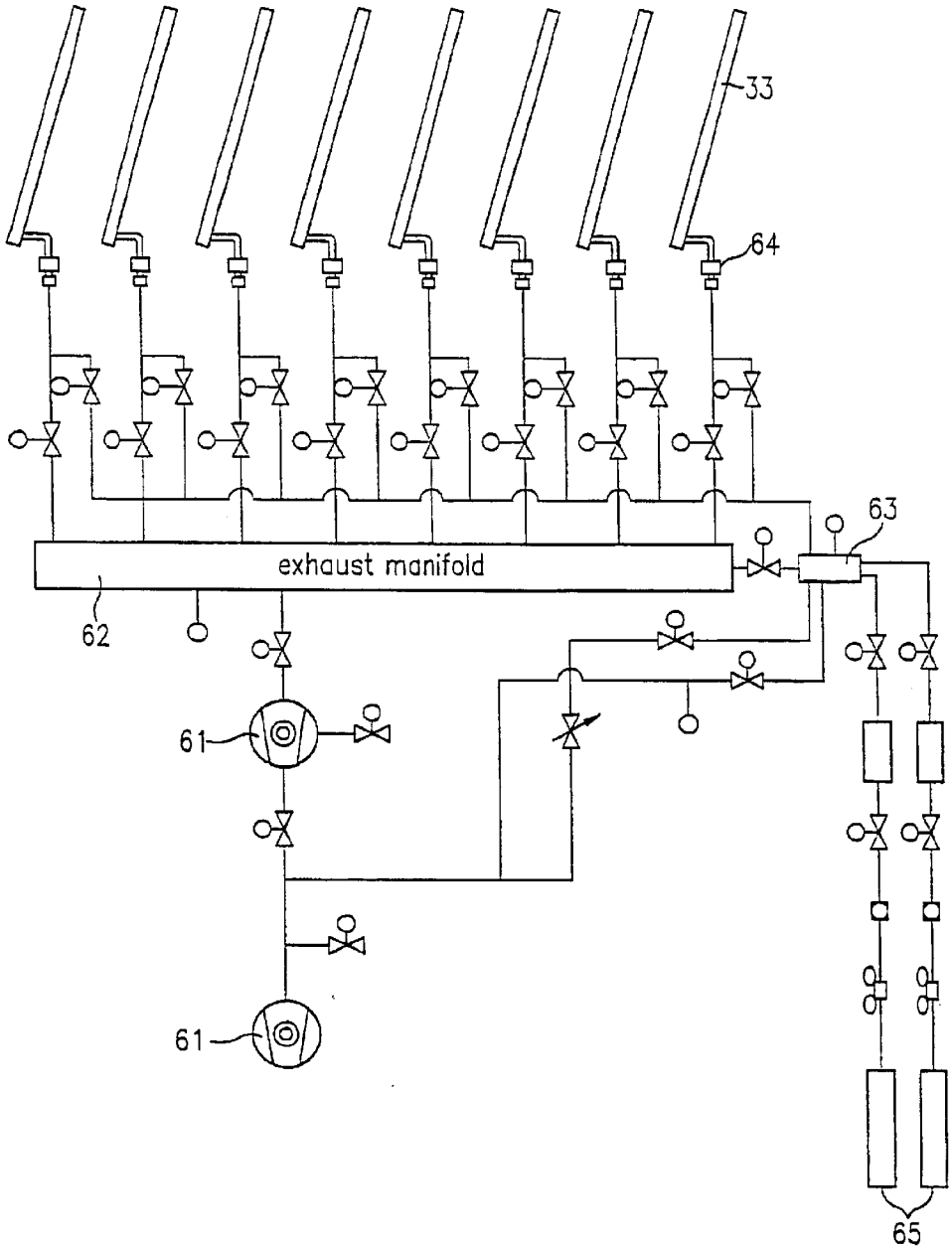
FIG. 6 Related Art
FIG. 6 illustrates a diagram of a cart in FIG. 5.
Figure 7:
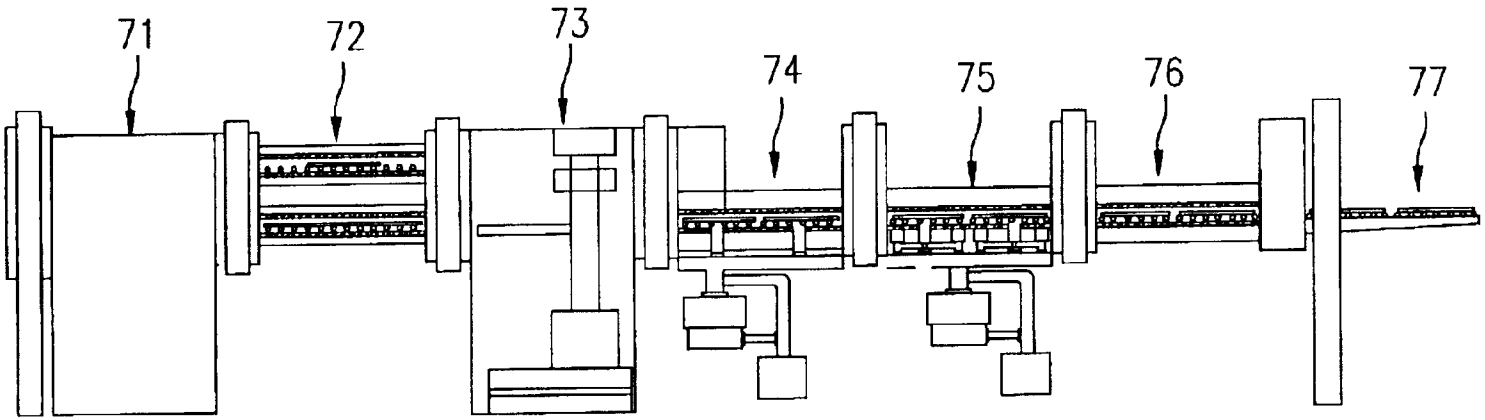
FIG. 7 illustrates a constructional diagram of an apparatus for fabricating a plasma display panel according to the present invention.
Figure 8:
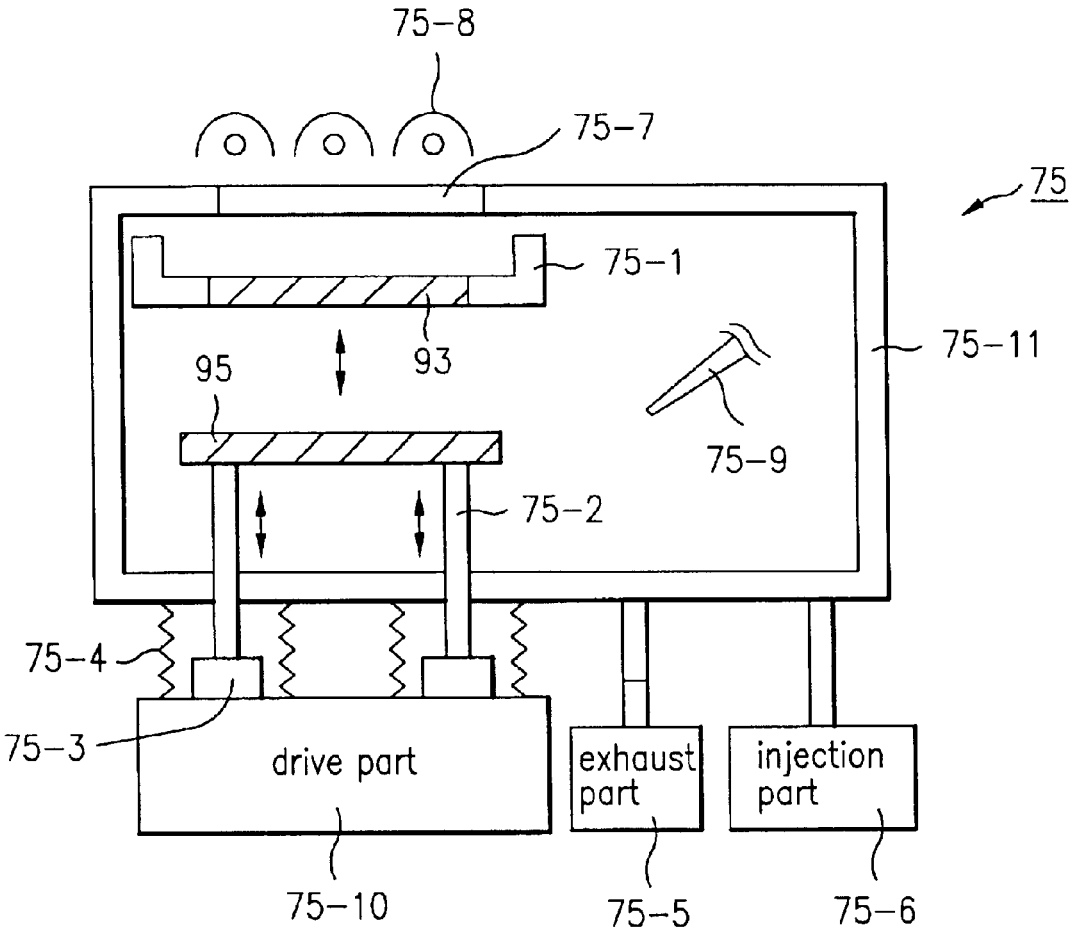
FIG. 8 illustrates a diagram of an electric discharge gas injection and bonding apparatus in a plasma display panel in FIG. 7.
Figure 9A:
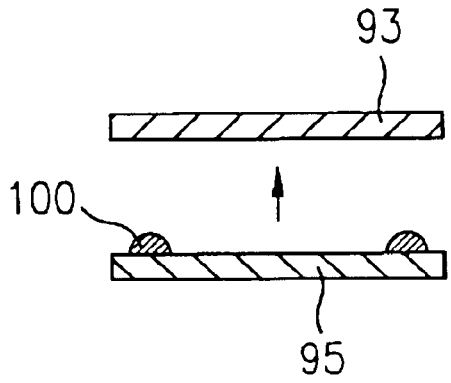
FIG. 9A and FIG. 9B illustrate cross-sectional views of a substrate-bonding process.
Figure 9B:
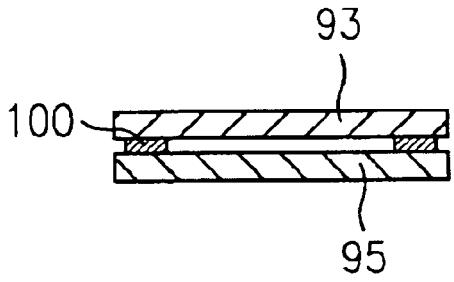

FIG. 7 illustrates a constructional diagram of an apparatus for fabricating a plasma display panel according to the present invention, FIG. 8 illustrates a diagram of an electric discharge gas injection and bonding apparatus in a plasma display panel in FIG. 7, and FIG. 9A and FIG. 9B illustrate cross-sectional views of a substrate-bonding process.

Referring to FIG. 7, an apparatus for fabricating a PDP according to the present invention includes an upper plate passivation layer forming equipment 71 forming a MgO passivation layer on a first substrate, i.e. an upper plate 93, a substrate transport equipment 72 receiving the upper plate 93 from the upper plate passivation layer forming chamber 71 and loading a second substrate 95, i.e. lower plate 95 so as to convey the first and second substrates to a next equipment without exposure to the atmosphere, a pre-alignment equipment 73 carrying out temporary alignment for bonding the upper/lower plates conveyed through the substrate transport equipment 72, a cleaning equipment 74 removing impurities existing on the upper and lower plates 93 and 95 pre-aligned through the pre-alignment equipment 73 and carrying out vacuum exhaust, an electric discharge gas injection/bonding equipment 75 coating the lower plate 95 cleaned through the cleaning equipment 74 with a sealant hardened by UV-rays, attaching the lower plate 95 to the upper plate 93 while an electric discharge gas is injected, aligning the attached upper and lower plates 95 and 93 using an alignment robot, irradiating a UV-ray so as to bond the upper and lower plates 93 and 95 to each other, and a panel unloading equipment 76 unloading the completed panel so as to transport the completed panel to a panel piling stand 77.

In this case, the apparatus according to the present invention is constructed with an airtight equipments built in one body so as not to be exposed to the atmosphere until the bonding of the upper plate 93 having the passivation layer 93 is completed.

The cleaning equipment 74 has a predetermined number of electrodes installed at corresponding locations so as to apply an electric field thereto to generate a plasma electric discharge by being contacted with the upper and lower plates 93 and 95.

The alignment robot uses a vision system for a part-handling industrial robot so as to carry out image-recognition and instrumentation on a predetermined object, i.e. upper and lower plates 93 and 95 through a CCD(charge coupled device) camera or the like and align the object to a corresponding location in accordance with a result of the instrumentation.

The electric discharge gas injection/bonding equipment 75, as shown in FIG. 8, includes a substrate fixing part 75-1 fixing the upper plate 93 transported from the cleaning equipment 74 to a predetermined location, a substrate support part 75-2 supporting the lower plate 95 transported from the cleaning equipment 74 and adjusting a distance from the upper plate 93 through up and down movement, a chamber 75-11 having a dispenser 75-9 inside to coat a sealant hardened by UV ray reaction on the lower plate 95 and a transparent window 75-7 as a path through which UV-rays are irradiated to the sealant, a UV-ray lamp 75-8 irradiating UV-rays through the transparent window 75-7 to the sealant, a drive part 75-10 driving the substrate support part 75-2 up and down, a bellows 75-4 making airtight the substrate support part 75-2 exposed outside the chamber 75-11, an exhaust part 75-5 for an exhaust of the chamber 75-11, and an electric discharge gas injection part 75-6 injecting an electric discharge gas into the chamber 75-11.

In this case, since a cross-sectional view of the electric discharge gas injection/bonding equipment 75 is shown in FIG. 8, there appear a pair of the substrate support parts 75-2. And, there are actually at least four substrate support parts 75-2 (not shown in the drawing entirely) so as to support the respective corners of the lower plate 95. And, a shock-absorbing means 75-3 like elastic member, spring, shock absorber, or the like is installed at each coupling part between each of the substrate support parts 75-2 and the drive part 75-10 so as to absorb a shock generated when each of the substrate support part 75-2 moves upward to attach the upper and lower plates 93 and 95 closely to each other.

A PDP fabricating method according to the present invention is described as follows.

First, the MgO passivation layer is formed on the upper plate 93 at high vacuum($10^{-7}$ Torr) and 200° C. in the upper plate passivation forming equipment 71 so as to be transported to the substrate transport equipment 72 without being exposed to the atmosphere.

Subsequently, the substrate transport equipment 72 receives the upper plate 93 having the passivation layer thereon on the same condition, i.e. $10^{-7}$ Torr and 200° C., of the upper plate passivation layer forming equipment 71, and then the lower plate 95 is loaded on the substrate transport equipment 72 so as to transport the upper and lower plates 93 and 95 to the pre-alignment equipment 73 without being exposed to the atmosphere.

And, the pre-alignment equipment 73 carries out the temporary alignment for the bonding of the upper and lower plates 93 and 95 transported from the substrate transport equipment 72 on the same condition of the substrate transport equipment 72 using the alignment robot having the vision system.

The temporarily aligned upper and lower plates 93 and 95 are transported to the cleaning equipment 74 without being exposed to the atmosphere, and then a cleaning step is carried out at a predetermined temperature and pressure (200° C. and variable inner pressure) in the cleaning equipment 74.

Namely, the upper and lower plates 93 and 95 are fixed thereto so as to leave a previously established distance enabling to generate a plasma electric discharge in the cleaning equipment 74, and then an initial inner vacuum state at $10^{-7}$ Torr is made by the exhaust means such as a vacuum pump or the like so as to remove the impurity gas primarily.

Subsequently, a cleaning electric discharge gas such as Ne, Ar, or the like is injected into the equipment. In this case, all kinds of gases enabling to generate electric discharge besides Ne and Ar are available for the electric discharge.

The plasma electric discharge is generated between the upper and lower plates 93 and 95 by the same principle of generating an electric discharge of general PDP in a manner that a power is applied to the electrodes contacted with the upper and lower plates 93 and 95. Therefore, the plasma electric discharge enables to remove the impurities from the upper and lower plates 93 and 95.

The panel having been cleaned is transported to the electric discharge gas injection/bonding equipment 75.

The upper and lower plates 93 and 95 are placed at a predetermined location by the substrate fixing part 75-1 and support part 75-2. A predetermined area of the lower plate 95 is then coated with the sealant 100, i.e. epoxy-based material hardened by UV-rays by the dispenser 75-9. In this case, the epoxy-based material has an excellent property of adhesiveness.

Subsequently, high vacuum exhaust is carried out on the chamber 75-11 using the exhaust part 75-5, whereby volatile components are discharged externally since the boiling point of a solvent dissolved in the sealant 100 decreases.

And, the electric discharge gas is injected into the chamber 75-11 up to a process pressure using the electric gas injection part 75-6.

The upper and lower plates 93 and 95 are aligned each other using the alignment robot after the completion of the electric discharge gas injection, and then the substrate support part 75-2 is raised so that the sealant 100, as shown in FIG. 9B, expands laterally by the pressure applied by the ascendance of the substrate support part 75-2. In this case, each of the shock-absorbing means 75-3 installed at the corresponding coupling portion of the drive part 75-10 prevents overpressure on the upper and lower plates 93 and 95 as well as maintain uniformly the pressure applied to the area coated with the sealant 100.

And, the UV-ray lamp 75-8 irradiates a UV-ray through the transparent window of the chamber 75-11 so as to harden the sealant 100. Thus, the upper and lower plates 93 and 95 are bonded to each other. In this case, the bonding step is carried out using the UV-ray lamp 75-8 at a room temperature.

After the completion of bonding the upper and lower plates 93 and 95, the bonded panel is transported to the panel unloading equipment 76.

Finally, the panel unloading equipment transports to pile the bonded panel on the panel-piling stand 77.

Accordingly, the PDP, fabricating apparatus and method thereof have the following advantages or effects.

First, the apparatus, which includes the equipments built in one body to be airtight from surroundings and having the vacuum condition to prevent generation or penetration of impurities, according to the present invention prevents the MgO passivation layer from being exposed to the atmosphere so as to prevent the occurrence of the impurity gas as well as minimize a time for impurity gas exhaust. Therefore, the present invention enables to reduce an overall process time and increase a productivity.

Second, the MgO passivation layer on the upper plate is not exposed to the atmosphere so as to move to the next fabricating step, thereby enabling to prevent the characteristic reduction due to the passivation contamination caused by the reaction between the MgO passivation layer and atmosphere.

Third, the impurities remaining on the panel are removed using the cleaning equipment, thereby enabling to prevent the reduction of the panel characteristics due to the remainders after the panel fabrication.

Fourth, the upper and lower plates are bonded to each other at a room temperature and the location moving means for the bonding of the upper and lower plates is equipped with a shock-absorbing function, thereby lessening the temperature or physical load applied to the panel. Therefore, the present invention enables to prevent the damage and characteristic degradation of the panel as well as minimize the energy loss thereof.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. An apparatus for fabricating a plasma display panel, comprising:

a passivation layer forming equipment comprising a first chamber, for forming a MgO passivation layer on a first substrate;

a cleaning equipment comprising a second chamber, for removing impurities existing on the first substrate having the passivation layer and a second substrate, and for carrying out vacuum exhaust; and an electric discharge gas injection/bonding equipment, comprising a third chamber, for coating a sealant hardenable by UV-rays on the second substrate cleaned through the cleaning equipment and, while the third chamber is filled with an electric discharge gas, irradiating the UV-rays on the second substrate attached closely to the first substrate so as to carry out a bonding between the first and second substrates.

2. The apparatus of claim 1, wherein the first and second substrates are upper and lower plates, respectively.

3. The apparatus of claim 1, wherein the electric discharge gas injection/bonding equipment further comprises:

a substrate fixing part for fixing the first substrate transported to a predetermined location;

at least one substrate support part for supporting the second substrate and capable of adjusting a distance between the first substrate and the second substrate;

a drive part for driving the substrate support part to adjust the distance between the first substrate and the second substrate;

a sealant dispenser inside the third chamber;

a transparent window on a surface of the third chamber; and a UV-ray lamp for irradiating the sealant through the transparent window.

4. The apparatus of claim 1, further comprising a shock-absorbing means installed at each coupling part between each of the substrate support parts and the drive part so as to absorb a shock generated when each of the substrate support parts moves the second and first substrates closely to each other.

5. The apparatus of claim 4, wherein the shock-absorbing means is one of an elastic member and a shock absorber.

6. The apparatus of claim 1, wherein the sealant is an epoxy.

7. The apparatus of claim 1, wherein the first, second, and third chambers are connected together to form an airtight body so that the first and second substrates are not exposed to the atmosphere until the bonding between the first and second substrates is completed.

8. The apparatus of claim 1, further comprising:

a panel unloading equipment for unloading a panel bonded by the electric discharge gas injection/bonding equipment so as to pile up externally; and a panel piling equipment for piling up the panel unloaded from the panel unloading equipment.

9. A method of fabricating a plasma display panel, comprising:

forming an MgO passivation layer on a first substrate in a passivation layer forming area;

transporting the first substrate having the MgO passivation layer and a second substrate to a cleaning area;

area removing impurities existing on the first and second substrates by generating a plasma electric discharge between the first and second substrates in the cleaning area using a first electric discharge gas in the cleaning area;

exhausting the cleaning area;

transporting the cleaned first and second substrates to a bonding area;

coating a UV-hardenable sealant on the first substrate in the bonding area;

filling the bonding area with a second electric discharge gas;

attaching the first substrate closely to the second substrate in the bonding area; and irradiating UV-rays on the sealant to bond the first and second substrates to each other in the bonding area.

10. The method of claim 9, wherein said coating of the sealant occurs after the cleaning area is exhausted.

11. The apparatus of claim 1, wherein said third chamber comprises a unitary chamber with a sealant disperser, a substrate support part, a substrate fixing part and a transparent window therein, wherein said first and second substrates are cleaned and bonded in situ in said third chamber after said first and second substrates are moved into predetermined positions by the substrate fixing part and the substrate support part, respectively.

12. The apparatus of claim 1, wherein said electric gas injection/bonding equipment comprises:

a drive part; and a substrate support panel, wherein said drive part moves the second substrate on the substrate support panel towards the first substrate, and wherein said drive part comprises:

a motorized portion; and a shock absorber.

13. The method of claim 9, wherein the method is carried out in an airtight, single body fabricating apparatus including a passivation layer forming apparatus.

14. The method of claim 9, wherein said transporting the cleaned first and second substrates to a bonding area comprises moving the first and second substrates into a chamber and aligning said first and second substrates, wherein said coating the UV-hardenable sealant on the first substrate occurs in said chamber by a disperser located in said chamber, and wherein said attaching the first substrate closely to the second substrate comprises moving a substrate support part in said chamber under said second substrate in said chamber using a drive part while said first substrate remains stationary in said chamber.

15. The method of claim 9, wherein said coating of said UV-hardenable sealant occurs after transporting said cleaned first and second substrates to a bonding area, and wherein said filling the bonding area with an electric discharge gas occurs after coating said UV-hardenable sealant but before attaching said first substrate closely to said second substrate.

16. The method of claim 9, wherein said attaching the first substrate closely to the second substrate comprises:

maintaining a position of the first substrate using a substrate fixing part; and moving said second substrate toward first substrate to a predetermined position by:

engaging a drive part;

moving a substrate support part with said engaged drive part;

disengaging said drive part when said second substrate is in said predetermined position, wherein said drive part includes a shock absorber; and absorbing a load created by said attaching the first substrate closely to the second substrate using said shock absorber if any load is created.

17. A plasma display panel fabrication apparatus, comprising:

a chamber;

a substrate fixing part in an upper portion of said chamber;

a substrate support part in a lower portion of said chamber across from said substrate fixing part;

a drive part attached to said substrate support part;

a shock absorber between said substrate support part and said drive part; and a sealant disperser in said chamber, wherein said drive part moves said substrate support part relative to said substrate fixing part to align portions of said plasma display panel for bonding, wherein said sealant disperser applies sealant to said portions of said plasma display panel for bonding, wherein said drive part moves said substrate support part after said sealant is applied to bond said portions of said plasma display panel, and wherein excess loads created by said drive part are absorbed by said shock absorber.

18. The apparatus of claim 17, wherein said chamber is a unitary chamber, wherein said drive part said moves substrate support part within said unitary chamber relative to said substrate fixing part also within said unitary chamber.

19. The apparatus of claim 17, further comprising:

an exhaust part connected to said chamber; and an injection part connected to said chamber, wherein said exhaust part creates vacuum exhaust discharging volatile components, and wherein said injection part injects electric discharge gas up to a predetermined process pressure after said exhaust is completed.

20. The apparatus of claim 17, further comprising airtight bellows making said substrate support part connected to said drive part airtight with said chamber.

* * * * *